US009827609B2

(12) United States Patent
Ide et al.

(10) Patent No.: US 9,827,609 B2
(45) Date of Patent: Nov. 28, 2017

(54) CAST MOLD FABRICATION DEVICE

(71) Applicant: LIGNYTE CO., LTD., Sakai-shi, Osaka (JP)

(72) Inventors: Isamu Ide, Osaka (JP); Fumio Ueno, Osaka (JP)

(73) Assignee: LIGNYTE CO., LTD., Osaka (JP)

( * ) Notice: Subject to any disclaimer, the term of this patent is extended or adjusted under 35 U.S.C. 154(b) by 93 days.

(21) Appl. No.: 14/400,907

(22) PCT Filed: Jul. 10, 2013

(86) PCT No.: PCT/JP2013/004278

§ 371 (c)(1),
(2) Date: Nov. 13, 2014

(87) PCT Pub. No.: WO2015/004695

PCT Pub. Date: Jan. 15, 2015

(65) Prior Publication Data

US 2016/0175925 A1 Jun. 23, 2016

(51) Int. Cl.
*B22C 15/24* (2006.01)
*B22C 9/12* (2006.01)
(Continued)

(52) U.S. Cl.
CPC ..... *B22C 15/24* (2013.01); *B22C 1/16* (2013.01); *B22C 9/02* (2013.01); *B22C 9/12* (2013.01)

(58) Field of Classification Search
CPC ..... B22C 9/12; B22C 15/00; B22C 15/24; B22C 15/245
See application file for complete search history.

(56) References Cited

U.S. PATENT DOCUMENTS 5,246,058 A * 9/1993 Murata ..... B22C 11/10 164/182
2008/0078523 A1 4/2008 Ide et al.
(Continued)

FOREIGN PATENT DOCUMENTS

JP 2000-107835 4/2000
JP 2009-241094 A 10/2009
(Continued)

OTHER PUBLICATIONS

International Search Report for the Application No. PCT/JP2013/004278 dated Oct. 8, 2013.

*Primary Examiner* — Kevin P Kerns
*Assistant Examiner* — Steven Ha
(74) *Attorney, Agent, or Firm* — Cheng Law Group, PLLC

(57) ABSTRACT

A cast mold fabricating device supplies thickener-coated sand and steam into a mold forming die at an optimum timing to shorten a mold fabrication time. The device includes the die 2 with an injection inlet 1, a sand supply head 4 for supplying and filling the thickener-coated sand 3 into the die, a steam supply head 5 for supplying steam into the die 2 to solidify and/or cure a thickener of the sand by application of heat of the steam. The device further includes a vertical drive 6 for lowering the sand supply head 4 to a position where the injection inlet 1 is connected to a sand nozzle 8 of the sand supply head 4, and a horizontal drive 7 for advancing the steam supply head 5 to a position where the injection port 1 is connected to a steam nozzle 9 of the steam supply head 5.

4 Claims, 14 Drawing Sheets

(51) Int. Cl.
*B22C 1/16* (2006.01)
*B22C 9/02* (2006.01)

(56) References Cited

U.S. PATENT DOCUMENTS

| | | | | |
|---|---|---|---|---|
| 2009/0236070 | A1 | 9/2009 | Ide et al. | |
| 2012/0217373 | A1* | 8/2012 | Ide | B22C 1/26 249/117 |

FOREIGN PATENT DOCUMENTS

| | | | | |
|---|---|---|---|---|
| JP | 2009-241135 | A | 10/2009 | |
| JP | WO 2011030795 | A1 * | 3/2011 | B22C 1/26 |
| JP | 2011-240385 | A | 12/2011 | |
| JP | 2013-107081 | A | 6/2013 | |
| JP | 2013-166180 | A | 8/2013 | |
| WO | WO-2006/054346 | A1 | 5/2006 | |
| WO | WO-2007/132669 | A1 | 11/2007 | |

* cited by examiner

CAST MOLD FABRICATION DEVICE

TECHNICAL FIELD

The present invention is related to a cast mold fabrication device, more particularly to the device configure to cast the mold by application of heat of steam.

BACKGROUND ART

Currently utilized molds are generally classified into a normal mold made of clay as a thickener into a green sand mold, high pressure mold, and high speed mold; a special mold made of a curable thickener into a thermosetting mold, self-cured mold, gas-curable mold, and precision casting mold; and other molds.

Although the molds of these kinds have advantages and disadvantages, they may suffer from problem in the mold fabrication, e.g. difficulty in fabricating the mold stably in a short time due to requirements of high temperature heating or much curing time, and generation of a toxic gas.

In order to alleviate the problem, it has been proposed a mold fabrication method that utilizes thickener-coated sand, generally referred to as resin-coated sand prepared by mixing a thickener with a refractory material. In this method, the thickener-coated sand is filled in a mold forming die and heated by steam blown into the die to solidify and/or cure the thickener, thereby bonding the refractory material by the thickener to complete the mold. Since the steam has inherently high condensation latent heat which is transferred to the thickener-coated sand, upon being blown into the die filled with the thickener-coated sand, thereby heating the sand quickly to solidify and/or cure the thickener. Accordingly, there is no necessity of applying the heat to the die itself, which enables the mold fabrication stably and in a short time, and reduces the amount of toxic gas being generated, refer to patent document (1).

For accomplishing the above method, a mold fabrication device is required to include, in addition to the mold forming die, a mechanism of supplying the thickener-coated sand into the die, and another mechanism of supplying the steam into the die. Such device is proposed in patent documents (2) and (3).

LIST OF PRIOR ART DOCUMENTS

Patent Document (1) Japanese patent No. P3563973

Patent Document (2) Japanese patent publication No. 2009-241094

Patent Document (3) Japanese patent publication No. 2009-241135

SUMMARY OF INVENTION

Problem to be Solved

Both of the mold fabrication devices in documents (1) and (2) are configured to give a unitary structure in which a mold forming die is integrated with a mechanism of supplying the thickener-coated sand into the die and also with a mechanism of supplying the heat into the die.

Therefore, these devices suffer from drawbacks of necessitating the die of complicated structure and being difficult to exchange dies of differently shaped dies. The devices are further required to select proper timings of supplying the thickener-coated sand and the steam as well in order to shorten the mold fabrication time.

The present invention has been accomplished in view of the above and has an object of providing the cast mold fabrication device which does not require the die of complicated structure and allow the supply of the thickener-coated as well as the steam respectively at optimum timings, and is therefore capable of shortening the mold fabrication time.

Means for Solving the Problem

The cast mold fabrication device in accordance with the present invention includes a mold forming die 2 having an injection inlet 1, a sand supply head 4 provided with a sand nozzle 8 and configured to supply thickener-coated sand 3 through the injection inlet 1 into the die 2. The thickener-coated sand 3 is a refractory material coated with a thickener. The device also includes a steam supply head 5 provided with a steam nozzle 9 and configured to supply steam through the injection inlet 1 into the die 2 filled with the thickener-coated sand 3 for applying heat of the steam to solidify and/or cure the thickener of the thickener-coated sand 3. Further included in the device are a vertical drive 6 arranged to move the sand supply head 4 up and down, and a horizontal drive 7 arranged to move the steam supply head 5 back and forth in the horizontal direction. The vertical drive 6 is configured to move the sand supply head 4 down to a position where the sand nozzle 8 is connected to the injection inlet 1 for allowing the thickener-coated sand 3 to be injected into the die 2. The horizontal drive 7 is configured to move the steam supply head 5 forward to a position where the steam nozzle 9 is connected to the injection inlet 1 for allowing the steam to be supplied into the die 2.

The die 2 is charged with the thickener-coated sand 3 with the vertical drive 6 being activated to move the sand supply head 4 for connection of the sand nozzle 8 to the injection inlet 1 of the die 2. The steam is blown into the die 2 with the horizontal drive 7 being activated to move the steam supply head 5 for connection of the steam nozzle 9 to the injection port 1 of the die 2. Thus, the device can eliminate the use of a specially designed die of complicated structure integrated with the mechanism of supplying the thickener-coated sand 3 into the die 2 as well as the mechanism of supplying the steam into the die 2, and can be easy to exchange the dies when necessary to change the kind of the die.

The sand supply head 4 is driven by the vertical drive 6 to move in the vertical direction towards and away from the injection inlet 1 of the die 2, while the steam supply head 5 is driven by the horizontal drive 7 to move in the horizontal direction towards and away from the injection inlet 1 of the die 2. That is, the sand supply head 4 and the steam supply head 5 are driven to move in different directions with an angle of 90° therebetween, thus allowed to move without being interfered with one another. Thus, the die 2 can be supplied with the thickener-coated sand 3 and the steam, respectively at optimum timings, which enables to shorten the mold fabrication time.

In a preferred aspect of the present invention, the steam supply head 5 is floatingly supported to be movable vertical and is biased upwardly. In this connection, the vertical drive 6 is configured to lower the sand supply head 4 to push the steam supply head 5 down for bringing the steam nozzle 9 into an intimate connection with the injection inlet 1, in response to the horizontal drive 7 moving the steam supply head 5 forward to a position above the die 2.

Thus, the vertical drive 6 lowers the sand supply head 4 to thereby press down the the steam supply head 5 so that the steam nozzle 9 comes into intimate contact with the injection inlet 1, whereby the steam can be successfully blown into the die 2 causing no leak from the interface between the steam nozzle 9 and the injection inlet 1. That is, the vertical drive 6 for vertically moving the sand supply head 4 is shared to give a function of bringing the steam nozzle 9 of the steam supply head 5 into intimate contact with the injection inlet 1 of the die, yet eliminating necessity of additional drive alone for pressing down the steam supply head 4.

In another preferred aspect of the present invention, the horizontal drive 7 is configured to hold the steam supply head 5 in a forward position where the steam nozzle 9 is connected to the injection inlet 1, a rearward position where the steam supply head 5 is away from the die 2, and a standby position intermediate between the forward position and the rearward position. The horizontal drive 7 is configured to hold the steam supply head 5 in the standby position while the sand supply head 4 is activated to supply the thickener-coated sand 3 into the die 2, and move the steam supply head 5 to the forward position in response to that the sand supply head 4 is lifted by the vertical drive 6 after finishing the supply of the thickener coated sand 3 into the die 2.

While the sand supply head 4 has its sand nozzle 8 kept connected to the injection inlet 1 of the die 2 for injecting the thickener-coated sand 3, the steam supply head 5 is held at the standby position near to the die 2 than at the rearward position such that the steam supply head 5 can be advanced to the position only in a short time for bringing the steam nozzle 9 into connection with the injection inlet 1 of the die 2 subsequent to the sand supply head 4 being lifted after finishing the supply of the thickener-coated sand 3 into the die 2, and allowed to start blowing the steam into the die 2. Thus, it is readily possible to shorten the mold fabrication cycle.

In a further preferred aspect of the present invention, the device further includes a sand tank 10 for storing the thickener-coated sand 3, and a sand supply horizontal drive 11 configured to move the sand supply head 4 back and forth in the horizontal direction. The sand supply horizontal drive 11 is configured to move the sand supply head 4 back to a position below the sand tank 10 for feeding the thickener-coated sand 4 into the sand supply head 4, and configured to move the sand supply head 4 forward to a position above the die 2 for supplying the thickener-coated sand 3 into the die 2.

Thus, the sand supply head 4 is driven to reciprocate between the position below the sand tank 10 and the position above the die 2 for receiving the thickener-coated sand 3 from the sand tank 10 and subsequently supplying the thickener-coated sand 3 into the die 2. With this arrangement, it is possible to eliminate necessity of storing much amount of the thickener-coated sand 3 in the tank 10, thereby enabling to make the sand supply head 4 compact.

In a still further preferred aspect of the present invention, the device further includes an air tubing 13 for supplying air into the sand supply head 4. The air tubing 13 is configured to flow pressurized air for blasting the thickener-coated sand 3 out of the sand supply head 4 into the die 2.

As the compressed air is responsible for blowing the thickener-coated sand 3 into the die 2, the sand can be filled in a short time successfully leaving no filling failure.

In a still further preferred aspect of the present invention, the device further includes a superheater 14 arranged to overheat the steam into superheated steam and supply it into the steam supply head 5.

The superheated steam is a high temperature dried water vapor of gas phase which inhibits the steam from excessively condensing into the water in the die 2, enabling to heat the thickener-coated sand 3 at a high rate and shorten the mold fabrication cycle.

Effect of Invention

According to the present invention, the thickener-coated sand 3 is supplied into the die 2 with the vertical drive 6 activated to move the sand supply head 4 for connecting the sand nozzle 8 to the injection inlet 1 of the die 2, while the steam is blown into the die 2 with the horizontal drive 7 activated to move the steam supply head 5 for connecting the steam nozzle 9 to the injection inlet 1 of the die 2. Thus, it is made possible to provide the die 2 free from being integrated with the mechanism of supplying the thickener-coated sand 3 into the die 2 and also with the mechanism of supplying the steam into the die 2. Further, it is possible to exchange the dies easily for fabricating differently shaped molds. In addition, since the sand supply head 4 is driven by the vertical drive 6 to move in the vertical direction toward and away from the injection inlet 1 of the die 2, and the steam supply head 5 is driven by the horizontal drive 7 to move in the horizontal direction toward and away from the injection inlet 1 of the die 2, the sand supply head 4 and the steam supply head 5 move in different directions apart by an angle of 90° and are therefore allowed to move without causing interference therebetween. Accordingly, even the device necessitates two type of heads, namely the sand supply head 4 and the steam supply head 5, it is made capable of injecting the thickener-coated sand 3 and blowing the steam into the die 2 respectively at optimum timings, and therefore shortening the mold fabrication time.

BRIEF DESCRIPTION OF DRAWINGS

FIG. 2, composed of FIGS. 2A to 2C, illustrates a mold forming block of the above device, in which

FIG. 4, composed of FIGS. 4A and 4*b*, illustrates the block carrying the sand supply head, in which

FIG. 6, composed of FIGS. 6A and 6B, illustrates the block carrying the steam supply head, in which

FIG. 7, composed of FIGS. 7A and 7B, illustrates a die of the device in which

FIG. 8, composed of FIGS. 8A to 8C, illustrates the sand supply head, in which

FIG. 9, composed of FIGS. 9A and 9B, illustrates a sand tank supplying the thickener-coated sand to the sand supply head, in which

FIG. 12, composed of FIGS. 12A to 12C, illustrates a manner of moving the steam supply head back and forth, in which

FIG. 13, composed of FIGS. 13A and 13B, illustrates the steam supply head and the sand supply head in relation to the die, in which

DESCRIPTION OF EMBODIMENTS

The present invention is now explained by way of its embodiments.

Figure 1:
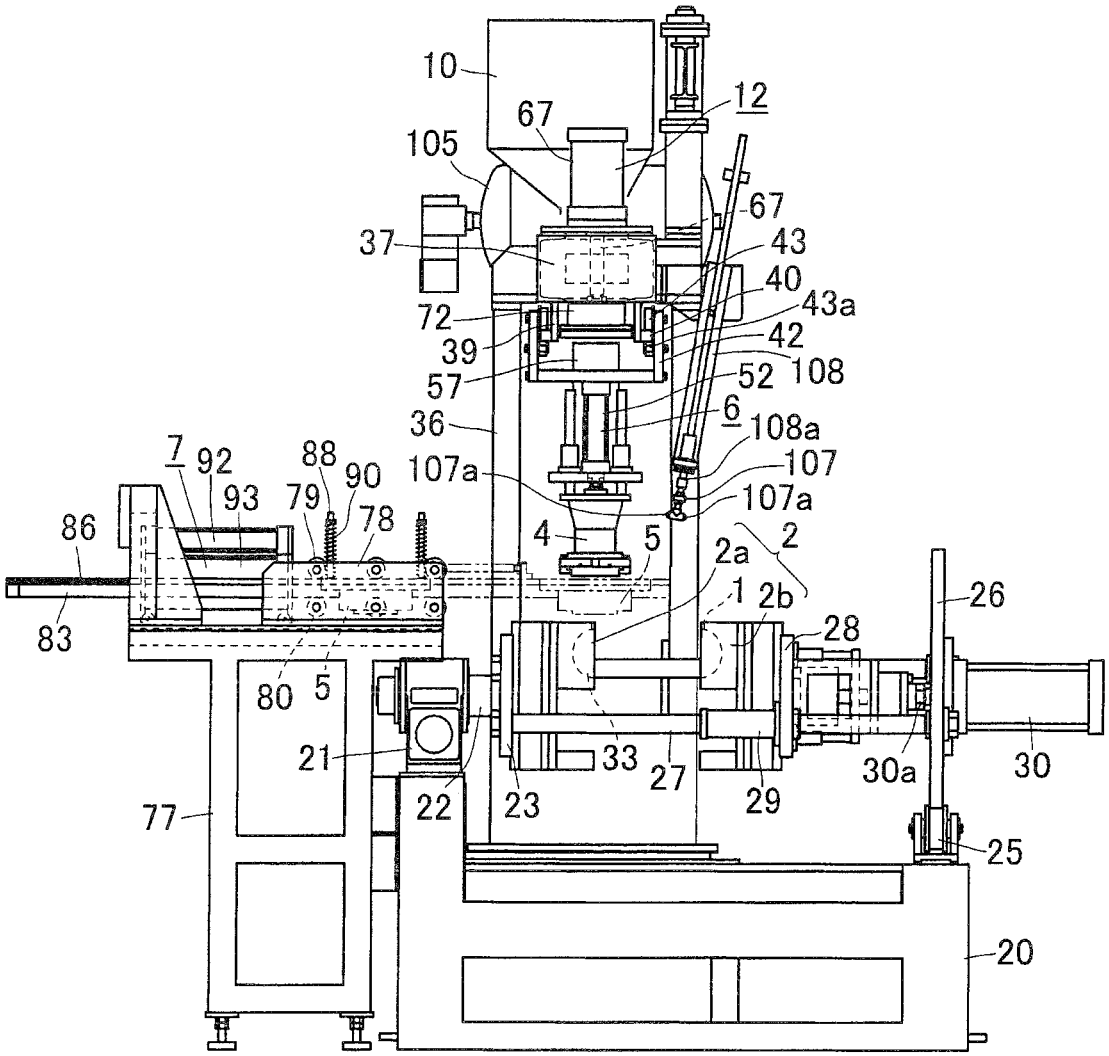
FIG. 1 is a front view illustrating a cast mold fabrication device in accordance with the present invention.

Referring to FIG. 1, there is shown a cast mold fabricating device in accordance with an embodiment of the present invention. The device includes a block carrying a mold forming die 2, a block carrying a sand supply head 4 for supplying thickener-coated sand 3 into the die 2, and a block carrying a steam supply head 5 for supplying steam into the die 2.

Figure 2A:
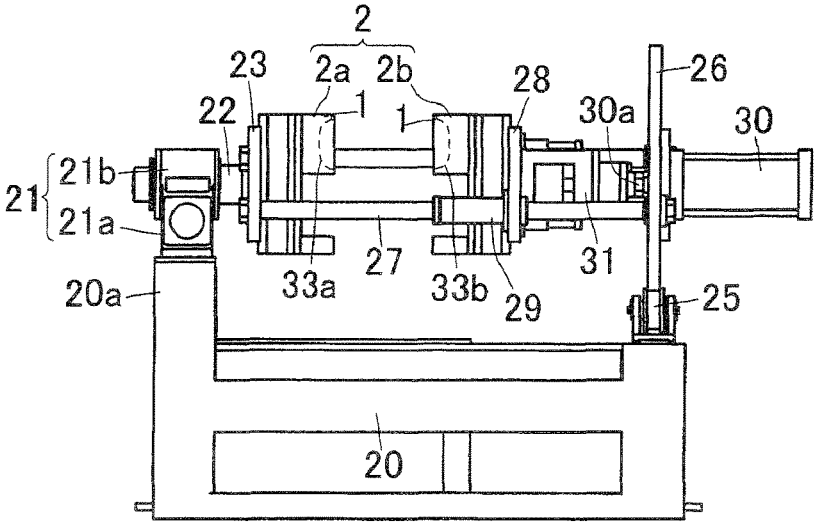
FIG. 2A is a front view of the block.
Figure 2B:
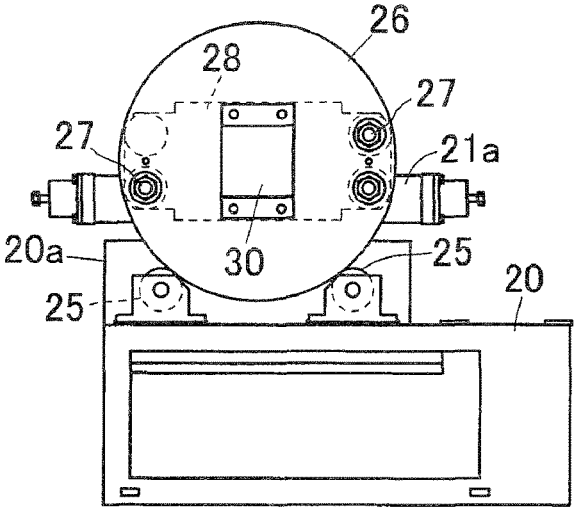
FIG. 2B is a right side view of the block.
Figure 2C:
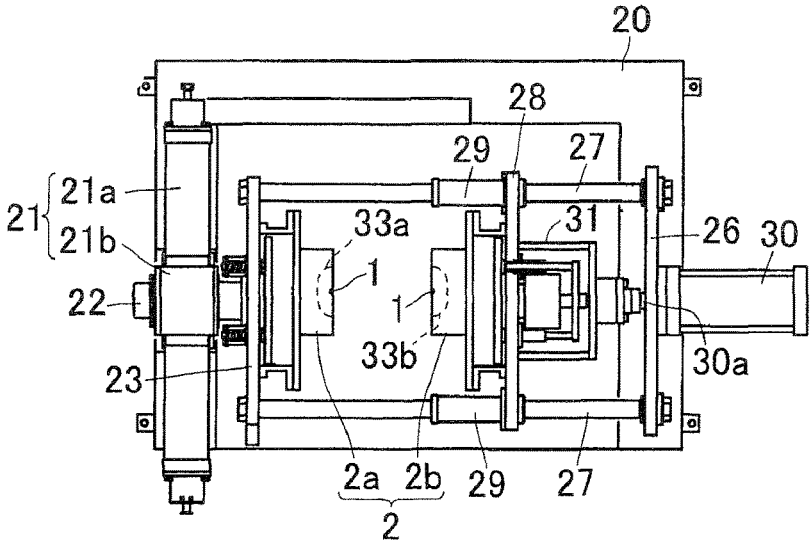
FIG. 2C is a plan view of the block.

First, an explanation is made to the block carrying the die 2 with reference to FIG. 2. The block includes a base 20 provided at is one end with an upstanding part 20*a* that carries on its top a turnover mechanism 21. The turnover mechanism 21 includes a lower rack unit 21*a* incorporating a rack (not shown) and an upper pinion unit 21*b* incorporating a pinion (not shown) that engages with the rack. The pinion unit 21*b* is located above a longitudinal center of the elongated rack unit 21*a* and is held together therewith. A cylinder unit is provided to linearly reciprocate the rack of the rack unit 21*a* in its longitudinal direction with an attendant rotation of the pinion of the pinion unit 21*b* engaged with the rack. The pinion unit 21*b* receives therethrough a fixed axle 22 around which the pinion is secured. The fixed axle 22 is provided at tis one end with a fixed die plate 23.

The base 20 is provided at its one end opposite to the upstanding part 20*a* with a pair of turnover support wheels 25 which supports a bidirectional turntable 26 that is coupled to the fixed die plate 23 by means of more than one connecting rod 27 extending therebetween. Thus, the bidirectional turntable 26 is supported on the pair of the support wheels 25 as being coupled to the fixed die plate 23. A movable die plate 28 is connected to be slidable along the connecting rods 27 with sleeves 29 of the die plate slidably fitted over the respective connecting rods 27. A die clamping cylinder unit 30 is secured to the outer face center of the turntable 26 with its cylinder rod 30*a* extending past through the turntable 26. The cylinder rod 30*a* is coupled through a coupler 31 to the movable die plate 28. When the cylinder unit 30 is activated to move the cylinder rod 30*a* in and out, the movable die plate 28 is caused to slide along the connecting rods 27 in a direction of moving toward and away from the fixed die plate 23.

Figure 7A:
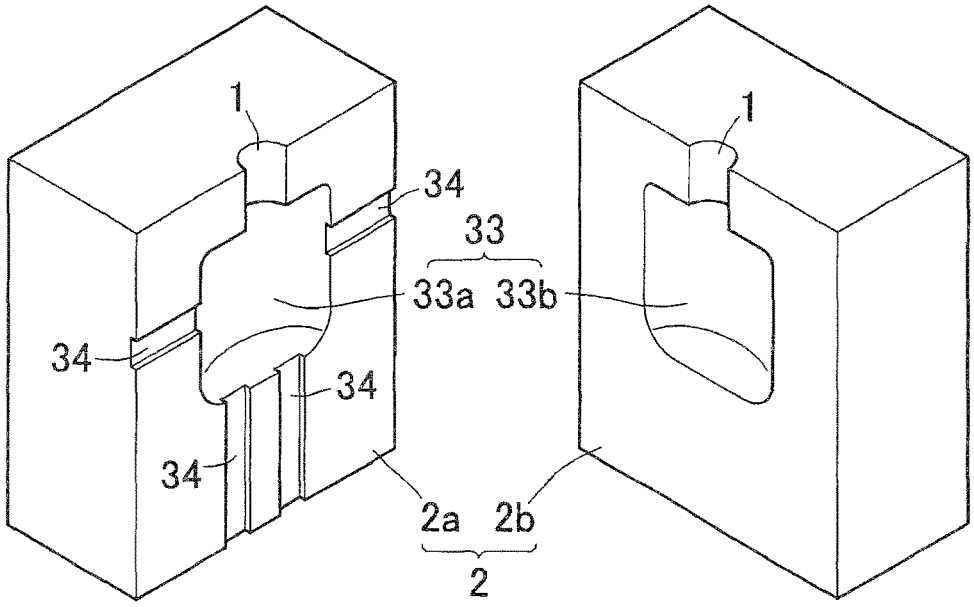
FIG. 7A is a perspective view of the die separated from the device.
Figure 7B:
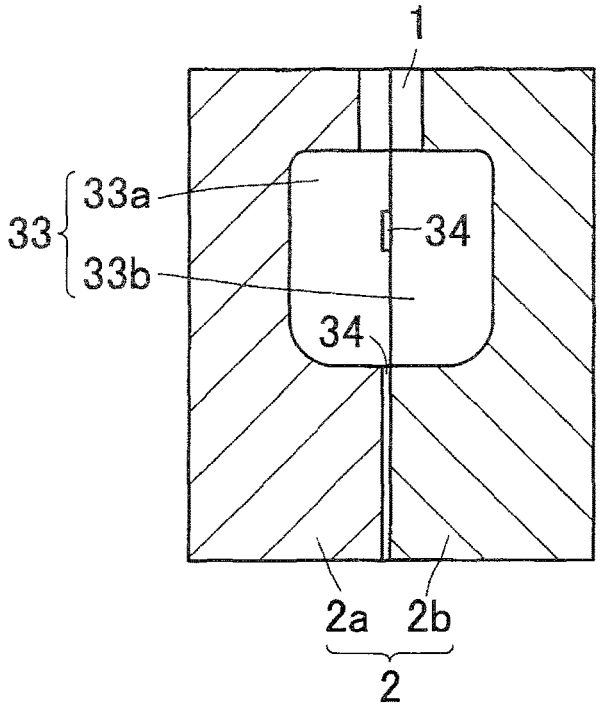
FIG. 7B is a sectional view of the die clamped to the device.

As shown in FIG. 7A, the die 2 is composed of a fixed die half 2*a* attached to the fixed die plate 23, and a movable die half 2*b* attached to the movable die plate 28. The die halves 2*a* and 2*b* are formed in their opposing faces respectively with recesses 33*a* and 33*b*. When the cylinder unit 30 is activated to advance the movable die plate 28 close to the fixed die plate 23, the die halves 2*a* and 2*b* are clamped together to form the die 2. Thus, the recesses 33*a* and 33*b* form a cavity 33 in the die 2, as shown in FIG. 7B. At this time, the die 2 is formed with an injection inlet 1 that is open on top of the die 2 and leading to the cavity 33. At least one of the die halves 2*a* and 2*b* is formed in its surface with an air vent 34 for discharging gas or steam from within the cavity 33. The air vent 34 is in the form of a shallow groove which allows escape of the gas but not the thickener-coated sand 3. The halves 2*a* and 2*b* are embedded with an electric heater for heating the die 2. Since the present invention is not aimed to apply the heat from the die 2 to the thickener-coated sand 3 for fabrication of the mold, the die 2 is heated only to a relatively low temperature that will not lower the temperature of the steam or steam supplied into the die 2. The die 2 can be readily exchanged in a short time for another die 2 simply by mounting die halves 2*a* and 2*b* of another die 2 respectively to the fixed plate 23 and the movable die plate 28.

As explained in the above, when the rack unit 21*a* of the turnover mechanism 21 is activated to rotate the pinion of the pinion unit 21*b*, the fixed axle 22 rotates together with the pinion. The fixed die plate 23 is secured to the fixed axle 22, while the movable die plate 28 and the bidirectional turntable 26 on the turnover support wheels 25 are coupled to the fixed die plate 23 by means of connecting rods 27. When the turnover mechanism 21 is activated to rotate the fixed axle 22, the bidirectional turntable 26 rotates on the turnover support wheels 25 together with the fixed die plate 23, thereby rotating the movable die plate 28 all together, and accordingly rotating the die 2 composed of the die halves 2*a* and 2*b* respectively to the fixed plate 23 and the movable die plate 28. The clamped die 2 is positioned with its injection inlet 1 oriented upward for filling the thickener-coated sand 3 into the cavity 33. Thereafter, the die 2 is rotated 180 degrees to orient the injection inlet 1 downward for discharging non-cured thickener-coated sand 3 from within the cavity 33 out through the injection inlet 1, while remaining the cured thickener-coated sand 3 within the cavity 33.

Figure 3:
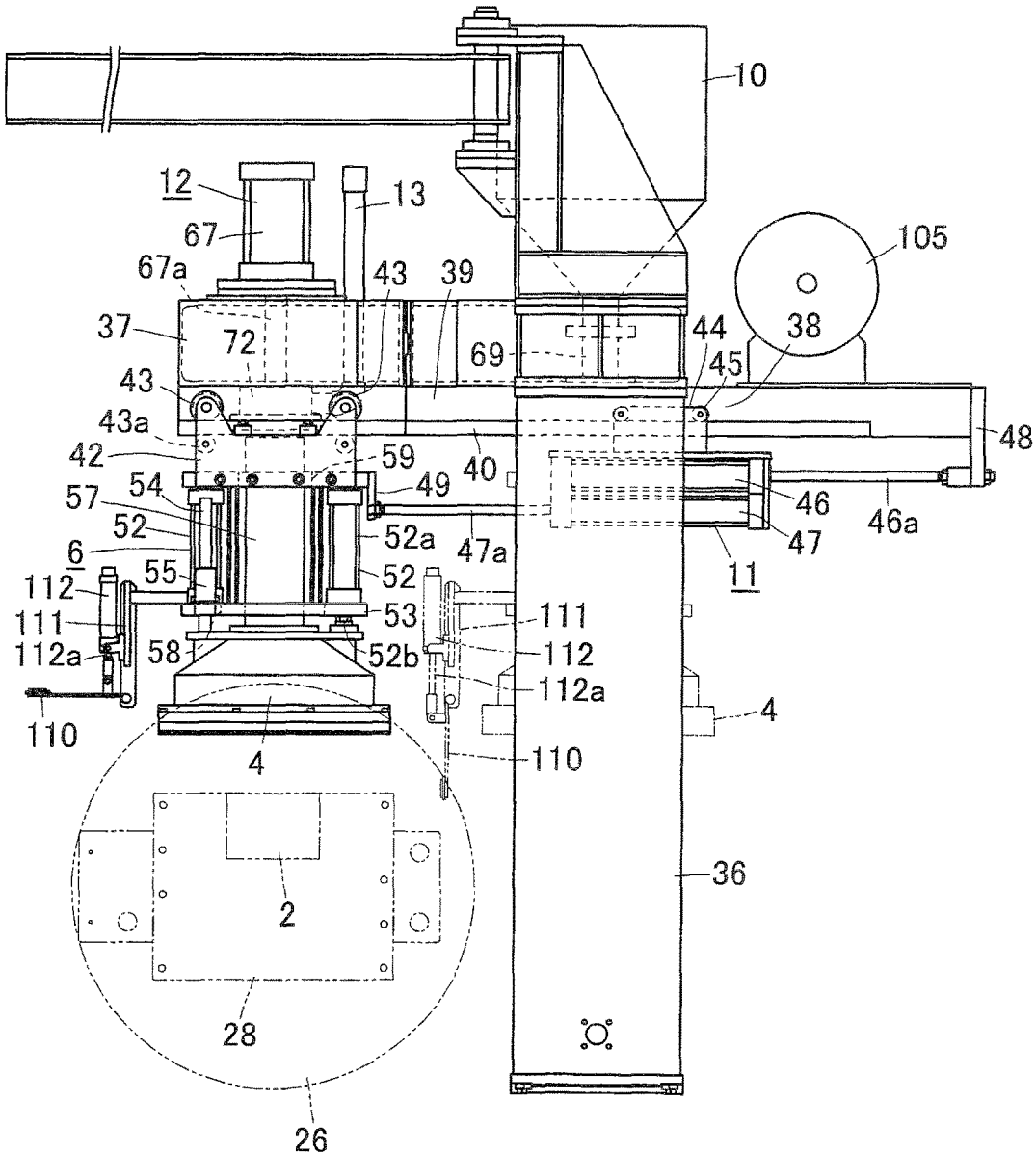
FIG. 3 is front view of a block of the above device provided with a sand supply head.
Figure 4A:
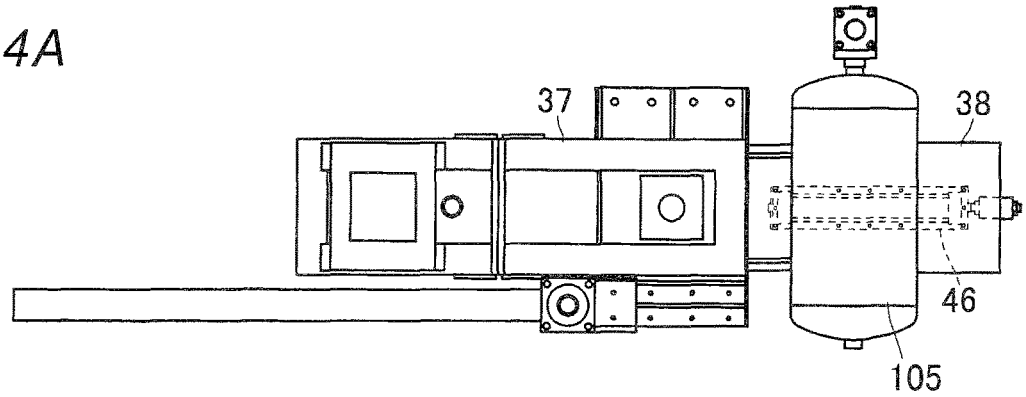
FIG. 4A is a plan view of the block.
Figure 4B:
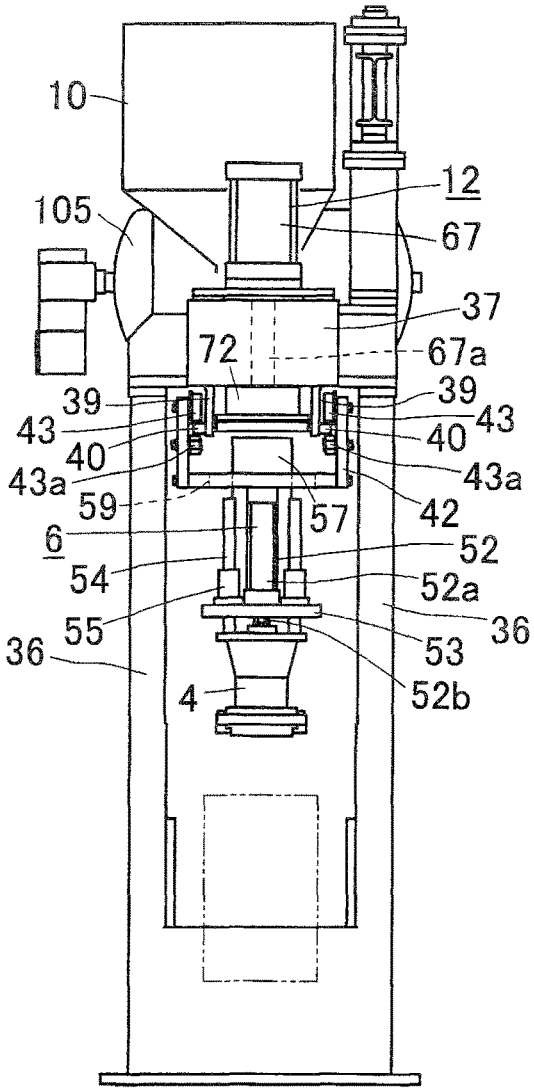
FIG. 4B is a left side view of the block.

Referring to FIGS. 3 and 4, an explanation is made to the block carrying the sand supply head 4. The block includes a pair of stands 36 of which upper ends are connected to one end of a horizontally extending support beam 37. The support beam 37 is provided on its bottom with a horizontally extending guide 38, one end of which extends beyond the support beam 37. The guide 38 has opposite sides 39 along which rails 40 extend horizontally in opposed relation with the lower ends of the sides 39.

The block includes a trolley 42 which is provided at each of opposite upper ends with a pair of wheels 43 and supported by the rails 40 with the wheels 43 rested on the rails 40. Anti-floating rollers 43*a* are provided below the wheels 43 at position opposite of the rails 40 from the wheels 43. The block also includes a sub-trolley 44 having a pair of wheels 45 at each of opposite upper ends and being supported by the rails 40 with the wheels 45 rested on the rails 40. The sub-trolley 44 is connected at its lower end to a pair of horizontally extending cylinder units 46 and 47 provided respectively with cylinder rods 46*a* and 47*a* extending in opposite direction to one another. The cylinder rod 46*a* of the cylinder unit 46 is secured at its top end with a fixed plate 48 depending from one end of the guide 39, while the cylinder rod 47*a* of the other cylinder unit 47 is secured at its top to a connector plate 49 of the trolley 42. When the cylinder units 46 and 47 are activated to move the respective cylinder rods 46*a* and 47*a* inward and outward, the sub-trolley 44 moves along the rails 40 together with the cylinder units 46 and 47, thereby moving the trolley 42 along the rails 40 in a stroke twice the stroke in which the cylinder rods 46*a* and 47*a* move. The cylinder units 46 and 47 constitute a sand discharging horizontal drive 11.

The trolley 42 is secured at its lower end to a rear end of another cylinder unit 52 with vertically oriented cylinder 52*a* that carries a bottom plate 53 at its lower end. The cylinder unit 52 includes a cylinder rod 52*b* that extends from the lower end of the cylinder unit 52 and carries the sand supply head 4 at its lower end. Slide rods 54 extend from the upper end of the sand supply head 4 and is slidably received in guide sleeves 55 in the bottom plate 53 so as to make the sand supply head 4 to vertically movable. Thus, the sand supply head 4 is driven to move up and down as the cylinder unit 52 is activated to move the cylinder rod 52*b* inward and outward. The cylinder unit 52 constitutes a vertical drive 6 for moving the sand supply head 4 up and down.

Figure 8A:
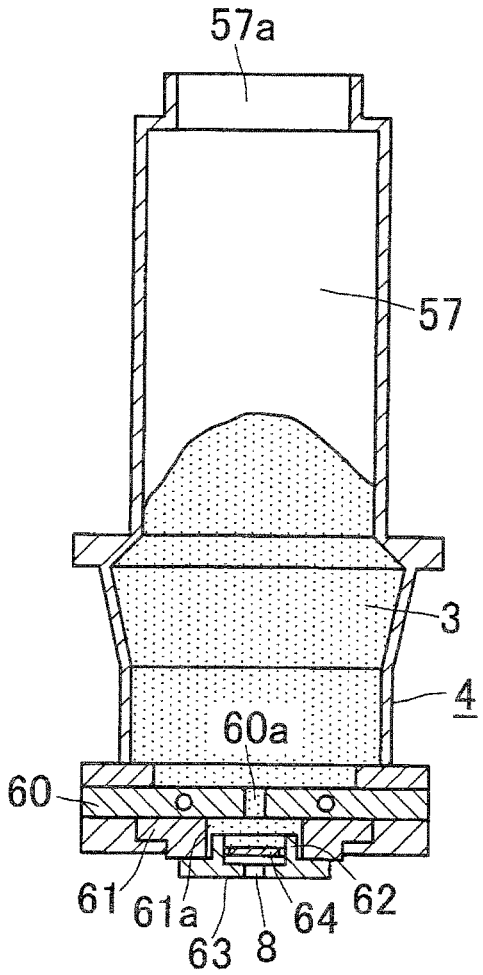
FIG. 8A is a sectional view of the head.

As shown in FIG. 8A, extending upward from the sand supply head 4 is a cylindrical sand introduction barrel 57 that is formed in its bottom with a sand nozzle 8 and in its top with an opening 57*a*. The sand introduction barrel 57 extends through an opening 58 of the bottom plate 53 and also through an opening 59 of the trolley 42 to be made vertically movable together with the sand supply head 4 (see FIG. 3).

As shown in FIG. 8A, a cooling plate 60 is disposed at the bottom of the sand supply head 4 and is configured to receive therethrough water for cooling. The cooling plate 60 interrupts heat transfer from the heated die 2 to the sand supply head 4 for protecting the thickener-coated sand 3 in the head from the heat. The cooling plate 60 is formed in its center with a communication hole 60*a* around which a nozzle mounting plate 61 is fixed to the bottom of the cooling plate 60. The nozzle mounting plate 61 is formed with a nozzle mounting hole 61*a* that is open to the communication hole 60*a* and is fitted with a nozzle sleeve 62.

Figure 8B:
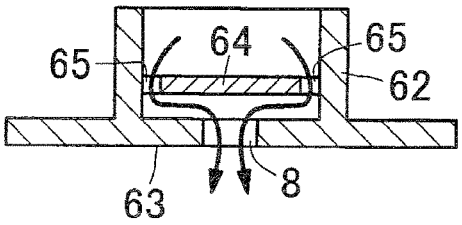
FIG. 8B is an enlarged sectional view of the head.
Figure 8C:
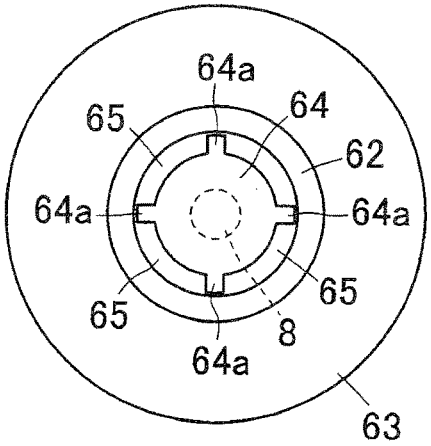
FIG. 8C is an enlarged plan view of the head near its nozzle.

As shown in FIG. 8B, the nozzle sleeve 62 is of cylindrical configuration having its bottom closed by a flanged bottom 63 that is formed in its center with the sand nozzle 8. The sand nozzle 8 communicates with the interior of the sand supply head 4 through the nozzle mounting hole 61*a* and the communication hole 60*a*. Mounted within the nozzle sleeve 62 is a circular baffle plate 64 with spacer projections 64*a* that are evenly spaced around the circumference of the baffle plate and are of the same projection height, as shown in FIG. 8C. The baffle plate 64 is held away from the flanged bottom 63 with the spacer projections 64*a* abutting against the inner periphery of the nozzle sleeve 62 to vertically separate the interior of the nozzle sleeve 62. The spacer projections 64*a* leave small clearances 65 between the baffle plate 64 and the inner periphery of the nozzle sleeve 62 for intercommunication between the upper and lower spaces on opposite of the baffle plate 64.

The thickener-coated sand 3 is to be discharged from the sand supply head 4 through the communication hole 60*a* of the cooling plate 60, the mounting hole 61*a* of the nozzle mounting plate 61, the nozzle sleeve 62, and through the sand nozzle 8. It is noted here that the nozzle sleeve 62 is fitted with the baffle plate 64 to leave therebetween only the small clearances 65 which are normally difficult to pass the thickener-coated sand 3 therethrough, and do not allow the sand 3 to be discharged only by force or load applied from the own weight of the sand 3. Especially, because of the presence of the small communication hole 60*a* between the baffle plate 64 and the interior of the sand supply head 4, the whole volume of the thickener-coated sand 3 in the sand supply head 4 does not apply its entire own weight to the baffle plate 64. Therefore, under a normal condition, the thickener-coated sand 3 is prohibited from being dispensed out through the sand nozzle 8. Nevertheless, as will be discussed later, the sand supply head 4 receives compressed air that pressurizes the thickener-coated sand 3 within the sand supply head 4, forcing it through the clearances 65 around the baffle plate 65 to dispense the thickener-coated sand 3 out through the steam nozzle 9, as indicated by arrows in FIG. 8B.

The support beam 37 is provided at its one end with a sand tank 10, and at the other end with a pusher cylinder unit 67. The trolley 42 is driven to move horizontally by the sand charging horizontal drive 11 including the cylinder units 46 and 47, thereby reciprocating the sand supply head 4 carried by the trolley 42 between a position immediately below the sand tank 10 and a position immediately below the pusher cylinder unit 67.

Figure 9A:
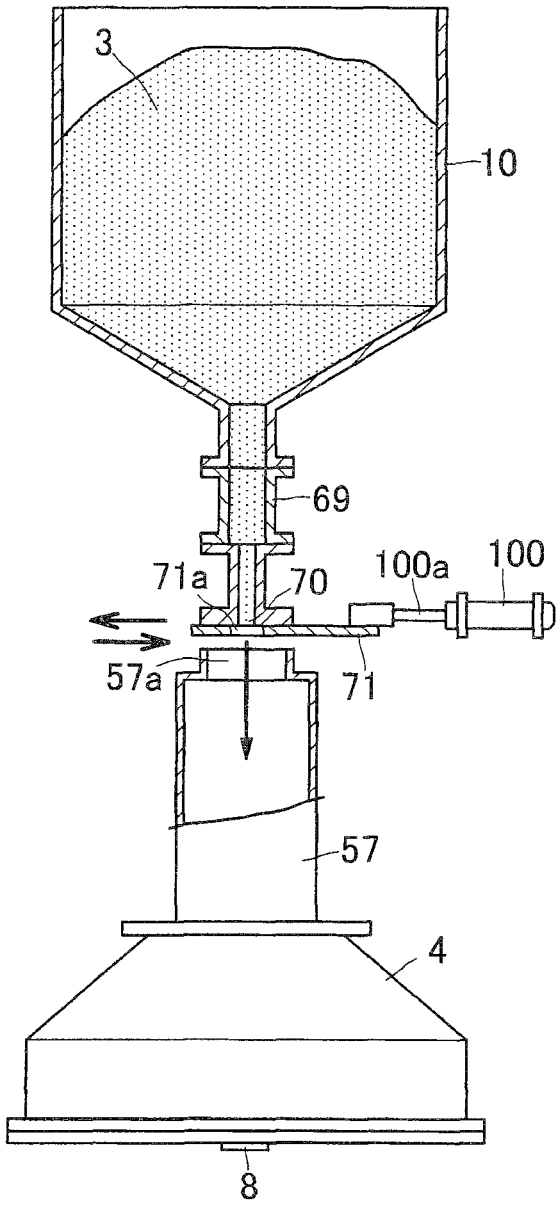
FIG. 9A is a sectional view of the tank.
Figure 9B:
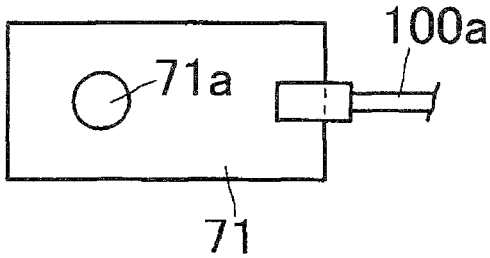
FIG. 9B is an enlarged plan view of a sand shutter between the tank and the head.

The sand tank 10 is provided to store the thickener-coated sand 3, and is provided with a dispense barrel 69 which, as shown in FIG. 9A, extends downward from a funnel-shaped lower end of the tank and is formed at its lower end with a dispense port 70. The dispense pot 10 is closed and opened by a sand shutter 71 that has a shutter port 71*a*, as shown in FIG. 9B, and is driven to open and close by a shutter drive cylinder unit 100 having a cylinder rod 100*a* secured at its end to the shutter 71. The sand shutter 71 is disposed in sliding contact with the lower end of the dispense barrel around the dispense port 70, and is driven to reciprocate by the shutter drive cylinder unit 100. When the sand shutter 71 is positioned with its shutter port 71 mated with the dispense port 70 of the sand tank 10, the dispense port 70 is opened so that the thickener-coated sand 3 is dispensed out through the shutter port 71 by its own weight. When the sand shutter 71 is driven by the shutter drive cylinder unit 100 to move away from the above position, it closes the dispense port 70 to avoid the thickener-coated sand 3 from being supplied from the sand tank 10. Normally, the sand shutter 71 keeps the dispense port 70 closed.

Figure 10:
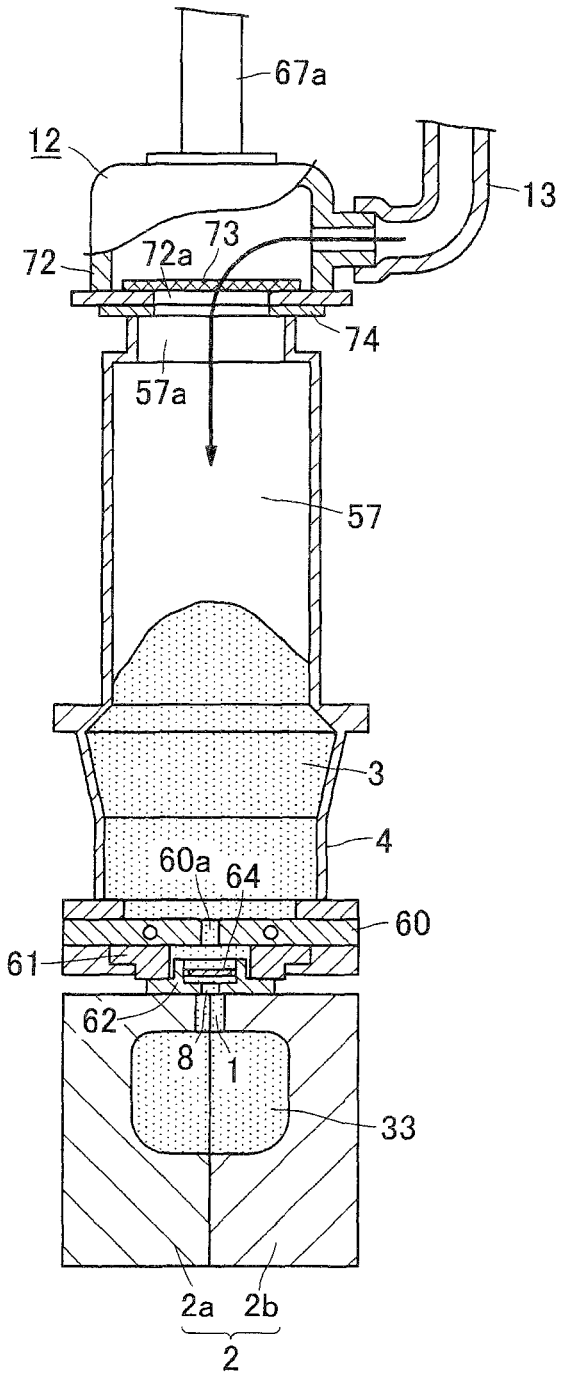
FIG. 10 is a sectional view illustrating the sand supply head supplying the thickener-coated sand into the die.

The pusher cylinder unit 67 is disposed vertically with its cylinder rod 67*a* that extends downward from the pusher cylinder unit to carry at its lower end a pusher barrel 72. As shown in FIG. 10, the pusher barrel 72 is a top-closed and bottom-closed tube and is provided with a net 73 covering a lower opening 72*a*, and is provided with a sealing ring 74 around the outer circumference of the lower opening 72*a*. An air tubing 13 is connected to the side of the pusher barrel 72 to flow compressed air that is fed into the pusher barrel 72 to pass through the net 73 and spouts from the lower opening 72*a* at the lower end of the pusher barrel 72. The pusher cylinder unit 67 and the pusher barrel 72 constitute a sand supply head pusher unit 12.

Figure 5:
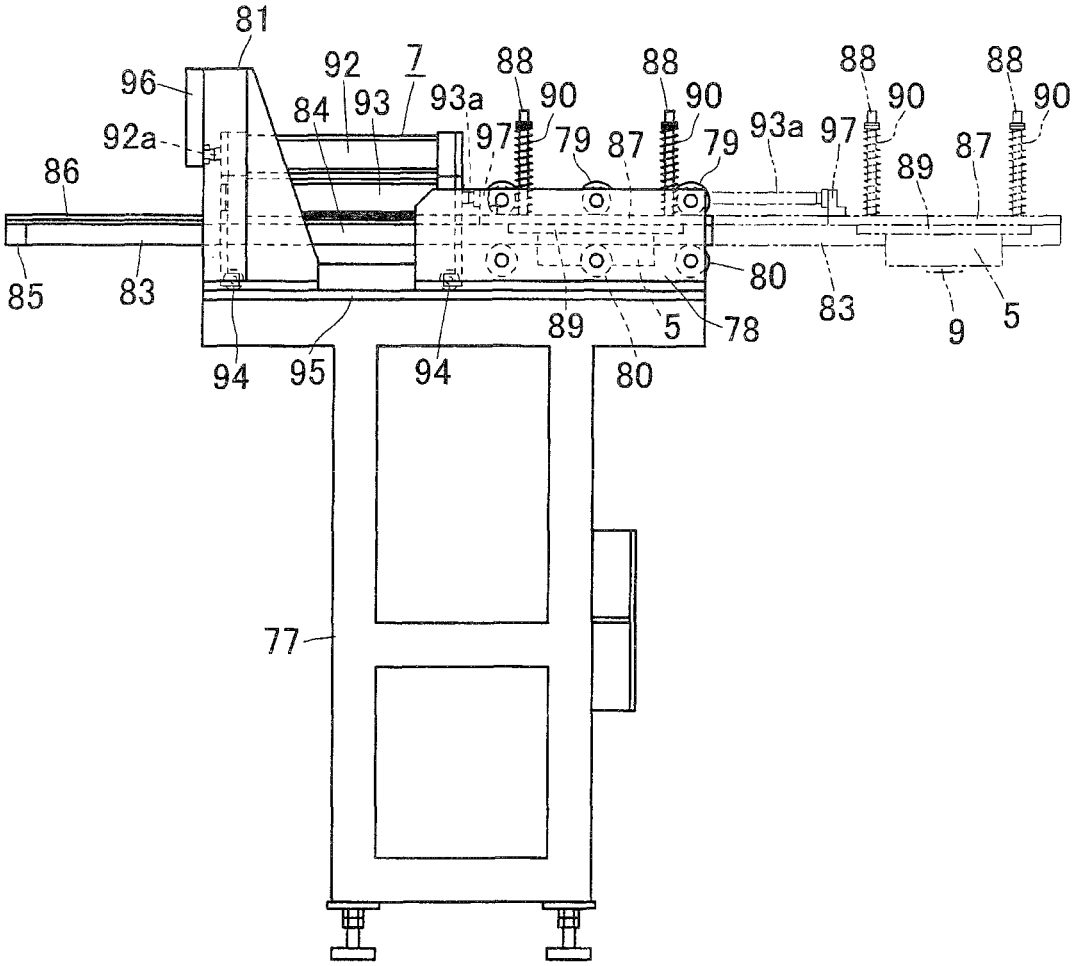
FIG. 5 is a front view of a block of the device carrying a steam supply head.
Figure 6A:
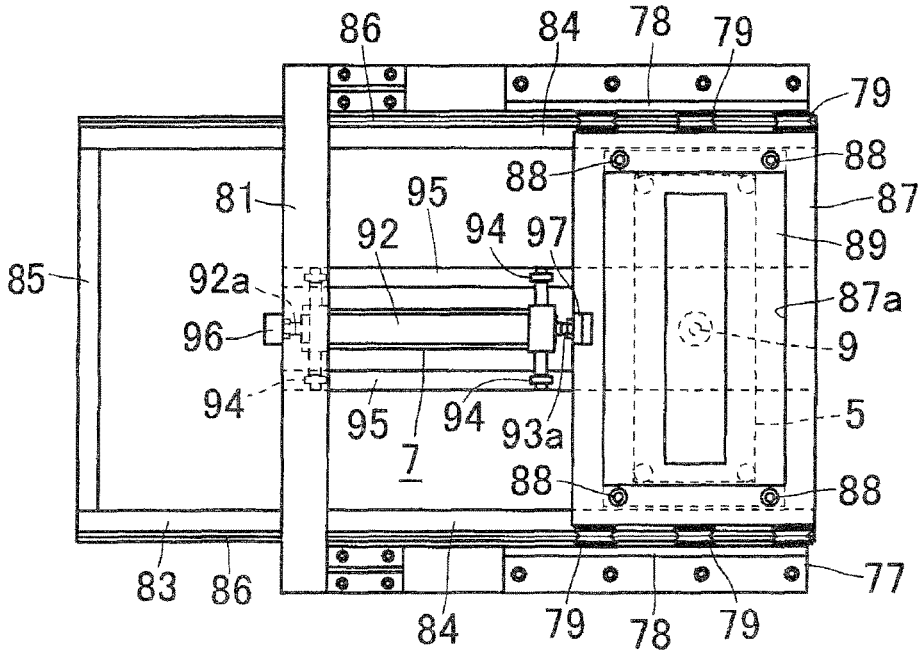
FIG. 6A is a plan view of the block.
Figure 6B:
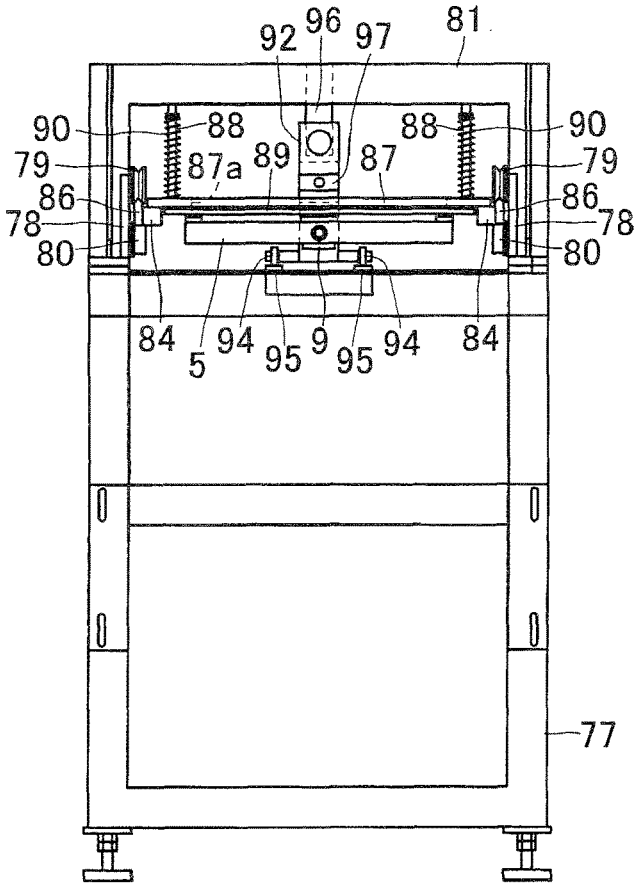
FIG. 6B is a right side view of the block.

Now, an explanation is made to the block carrying the steam supply head 5 with reference to FIGS. 5 and 6. The block includes a base 77 which is provided at its one end with a pair of support plates 78 projecting upward from its opposite sides, and is provided at the other end with gate-shaped rear support 81. Each of the support plates 78 carries on its inside face a series of upper rollers 79 at the same height as well as a series of lower rollers 80 respectively below the upper rollers 79.

Figure 13A:
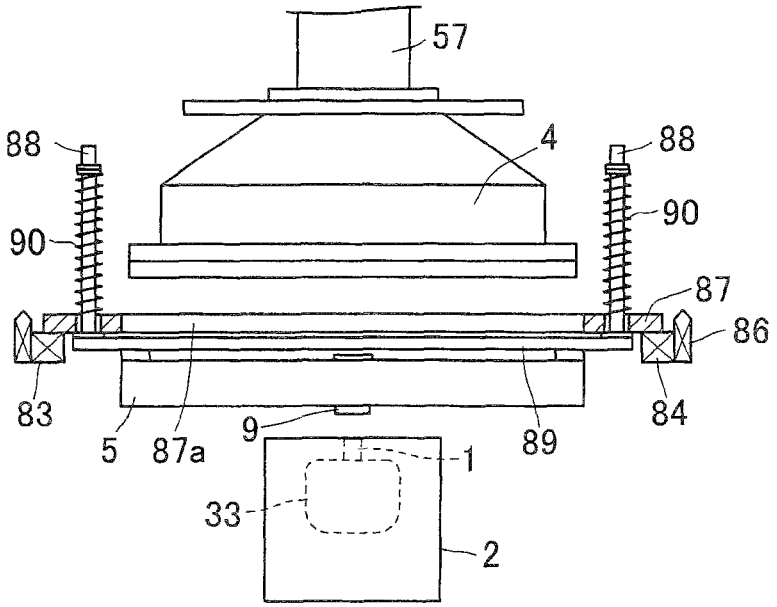
FIG. 13A is a sectional view of the heads separated from the die.

The block includes a slide frame 83 with a pair of frame members 84 connected together at their rear ends by a beam 85, and includes plate rails 86 each being of inverse-V shaped cross section with a pointed tip and extending the entire length along the outer face of each of the frame members 84. A retainer frame plate 87 bridges between the upper front ends of the frame members 84 and is provided on each of its opposite sides with a spaced pair of elevation guide pins 88 that are inserted in the frame member to be vertically movable relative to the frame member, and are connected at their lower ends to an elevator plate 89 disposed below the retainer frame plate 87. The elevator plate 89 is shaped to have greater dimensions than an opening 87*a* in the retainer frame plate 87. Each of the elevation guide pins 88 is biased upward by a spring 90 fitted therearound to give an upward bias of pulling the elevator plate 89 for abutment against the retainer frame plate 87, as shown in FIG. 13A.

Figure 11:
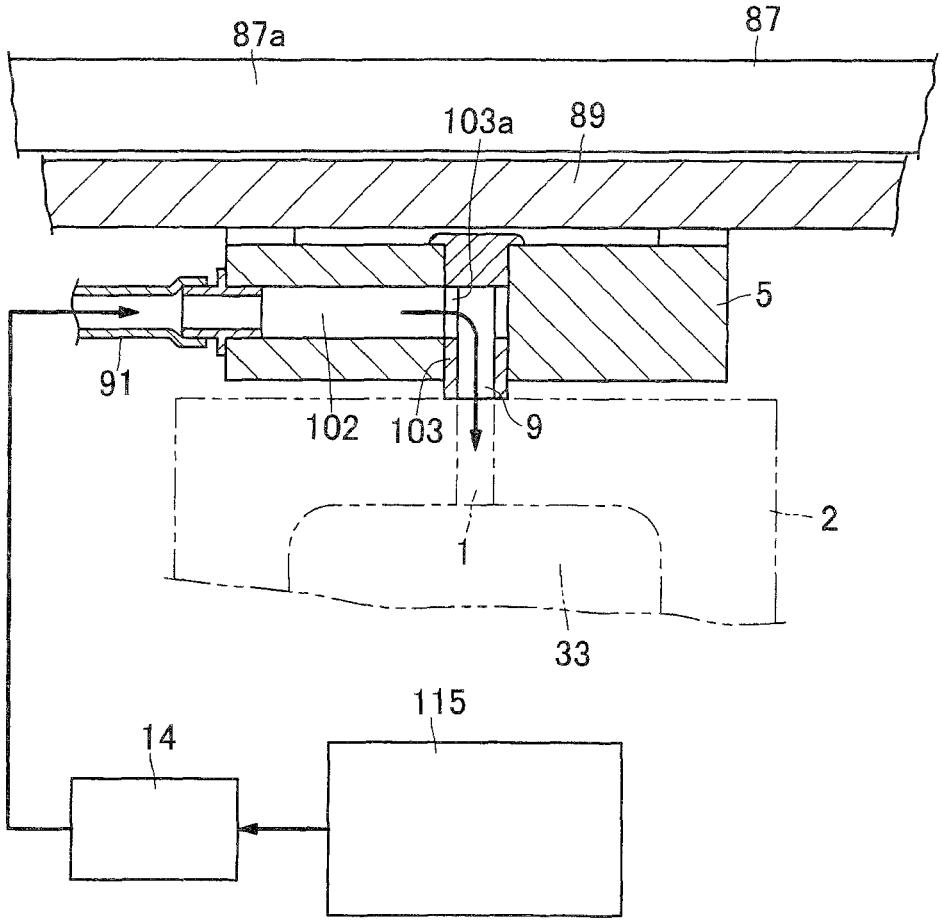
FIG. 11 is an enlarged sectional view of the steam supply head.

The steam supply head 5 is attached to the underside of the elevator plate 89, and is shaped in the form of a rectangular plate formed in its lower center with the steam nozzle 9. As shown in FIG. 11, the steam supply head 5 is formed therein with a steam path 102 that opens to the rear end as well as upper and lower ends thereof. A nozzle tube 103 is fitted from the above into a top-opened and bottom-opened vertical hole of the steam path 102. The nozzle tube 103 is a generally a top-closed and bottom-opened conduit formed in its side with an opening 103*a* open to the steam path 102. Thus, the nozzle tube 103 communicates with the steam path 102 through the opening 103*a*, and has an opened lower end that extends from the bottom of the steam supply head 5 to define the steam nozzle 9. A steam feed hose 91 is connected to the steam path 102 at the rear end of the steam supply head 5 to feed the steam into the steam supply head 5. The steam is then forced to spout out from the nozzle 9, as indicated by arrows in the figure.

The slide frame 83, thus holding the retainer frame plate 87 provided on its lower face with the elevator plate 89 and the steam supply head 5, is disposed on the base 77 with the opposite plate rails 86 engaged between the upper rollers 79 and the lower rollers 80 of the respective support plates 78 on opposite sides of the base 77, while being supported between the support plates 78. Since the slide frame 83 is supported with the opposite plate rails 86 interposed between the upper rollers 79 and the lower rollers 80, the slide frame 83 is allowed to slide back and forth with the plate rails 86 resting on the rotating upper rollers 79 and the lower rollers 90, thereby giving a sliding back and forth movement of the steam supply head 5 in the horizontal direction.

Mounted between the retainer frame plate 87 of the slide frame 83 and the rear support 81 of the base 77 is a horizontal drive 7 with a pair of horizontally disposed cylinder units 92 and 93. The cylinder units 92 and 93 are vertically stacked with respective cylinder rods 92*a* and 93*a* extending horizontally in the opposite directions from each other. The lower cylinder unit 93 is provided on its opposite sides at the lower end thereof with running wheels 94 that rest on respective rails 95 at the upper face of the base 77. The cylinder rod 92*a* of the cylinder unit 92 is connected at its projected end to a rear fixed plate 96 depending from the rear support 81, while the cylinder rod 93*a* of the cylinder unit 93 is connected at its projected end to a front fixed plate 97 upstanding from the rear end of the retainer frame plate 87.

When the cylinder units 92 and 93 are activated to move the respective cylinder rods 92*a* and 93*a* back and forth, the cylinder units 92 and 93 are caused to move with the running wheels 94 travelling on the plate rails 95, while at the same time the slide frame 83 are caused to slide with attendant rotations of the upper rollers 79 and the lower rollers 80, thereby moving the retainer frame plate 87 along the plate rails 85. Thus, the steam supply head 5 held by the retainer frame plate 87 is driven to move back and forth in a stroke twice that of the individual cylinder rods 92*a* and 93*a* of the cylinder units 92 and 93.

Figure 12A:
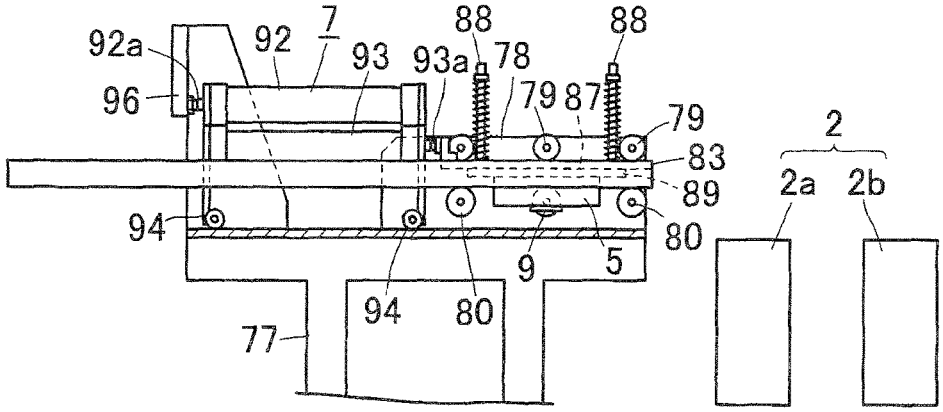
FIGS. 12A, 12B, and 12C are front sectional views respectively of the head.
Figure 12B:
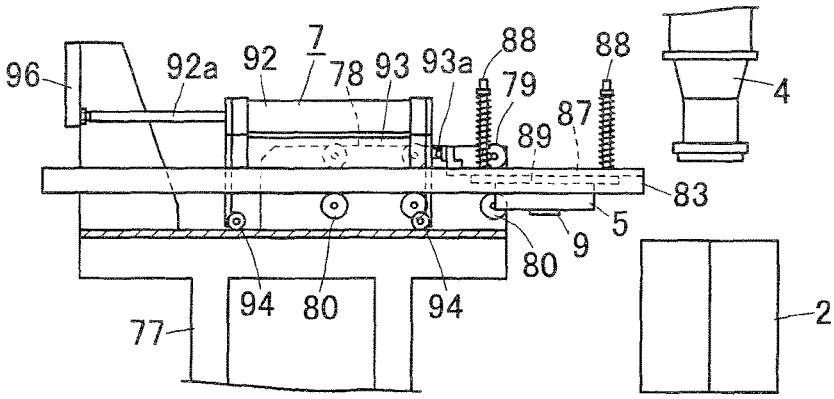
Figure 12C:
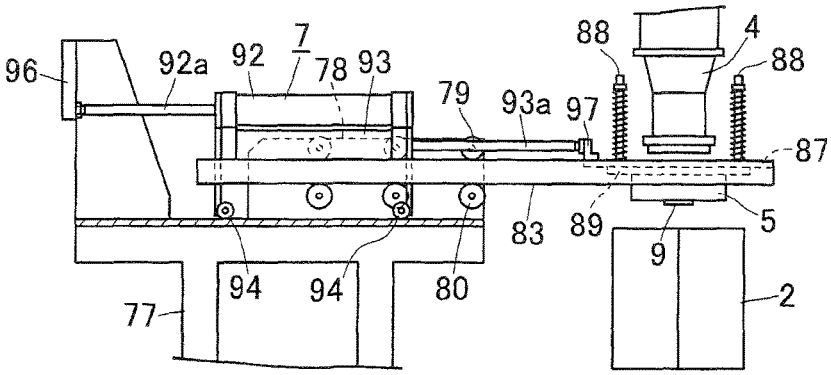

It is noted here that when the cylinder rods 92*a* and 93*a* of the cylinder units 92 and 93 are retracted, the steam supply head 5 is kept at a rearward-most position where the steam supply head 5 is disposed between the support plates 78, as shown in FIG. 12A. When the cylinder rods 92*a* and 93*a* of the cylinder units 92 and 93 are extended, the steam supply head 5 is kept at a forward-most position where the steam supply head 5 is projected forward of the base 77, as shown in FIG. 12C. When one of the cylinder units 92 and 93, for example, the cylinder unit 92 is alone activated to extend the cylinder rod 92*a*, the steam supply head 5 is held at a position intermediate the rearward-most and forward-most positions and disposed at the forward end of the base 77, as shown in FIG. 12B.

The mold fabrication device of the present invention is realized, as shown in FIG. 1, by a combination of the block carrying the die 2 shown in FIG. 2, the block carrying the sand supply head 4 shown in FIGS. 3 and 4, and the block carrying the steam supply head 5 shown in FIGS. 5 and 6. That is, the block carrying the sand supply head 4 is assembled on the block carrying the die 2 with the stands 36 of the latter block upstanding on the base of the former block to dispose the support beam 37 above the die 2 in such a manner that the sand supply head 4 moves horizontally in perpendicular relation with the opening and closing direction of the die 2. The block carrying the steam supply head 5 is assembled to dispose its base 77 behind the fixed die half 2*a* of the die 2, so as to move the steam supply head 5 horizontally in parallel with the opening and closing direction of the die 2. A tank 105 is provided in associate with an air compressor which supplies the compressed air to the above-mentioned cylinder units and the air tubing.

Now, an explanation is made to the thickener-coated sand 3 employed in the mold fabrication device of the present invention. The thickener-coated sand 3 is generally referred to as resin-coated sand (RCS) prepared by mixing a thickener with a refractory material to cover the refractory material with the thickener. The refractory material includes, although not limited to, silica sand, mountain sand, alumina sand, olivine sand, chromite sand, zircon sand, mullite sand, and artificial sand, and the like sand. The thickener is not particularly limited but selected from those generally used in the resin-coated sand for the shell-molding, and includes, for example, a thermosetting resin of phenolic resin or furan resin, sugar, a water-soluble inorganic compound, and a water-soluble thermoplastic resin.

The thickener-coated sand 3 is stored in the sand tank 10. The mold fabrication device of the present invention initiates a mold forming cycle with a step of supplying the thickener-coated sand 3 from the sand tank 10 into the sand supply head 4.

First, the cylinder units 46 and 47 constituting the sand charging horizontal drive 11 are activated to withdraw the individual cylinder rods 46*a* and 47*a*, thereby moving the sand supply head 4 rearward, as shown in FIG. 3, from a position on the left side of the guide 38 and indicated by solid lines to a position immediately below the sand tank 10, as indicated by dotted lines. When the sand supply head 4 is moved to the position immediately below the sand tank 10, the shutter drive cylinder unit 100 is activated to move the sand shutter 71 open the dispense port 70, allowing the thickener-coated sand 3 to fall by its own weight from the sand tank 10 through the dispense port 70. As shown in FIG. 9A, the sand supply head 4, when coming into the position immediately below the dispense port 70 of the sand tank 10, is charged with thickener-coated sand 3 though the opening 57*a* of the sand introduction barrel 57.

After being charged with the thickener-coated sand 3, the cylinder units 46 and 47 constituting the sand charging horizontal drive 11 are activated to extend the individual cylinder rods 48*a* and 47*a*, thereby advancing the sand supply head from the position immediately below the sand tank 10 to the left side of the guide 38, as indicated by solid lines in FIG. 3.

At this timing, the die 2 is clamped in synchronous with the advancing movement of the sand supply head 4. Initially, the fixed die half 2*a* and the movable die half 2*b* are separated from one another, as shown in FIGS. 2A and 2B. Then, the die clamping cylinder unit 30 is activated to extend the cylinder rod 30*a* to move the movable die half 2*b* towards the fixed die half 2*a*, thus clamping the die 2, as shown in FIG. 7B. Until the die clamping is completed, the sand supply head 4 completes its movement to the left side of the guide 83, as indicated by solid lines in FIG. 3, and is disposed immediately above the clamped die 2.

The steam supply head 5 also advances in synchronous with the clamping of the die 2. That is, when the die 2 is opened and the sand supply head 4 is retarded at the position immediately below the sand tank 10, one of the cylinder units 92 and 93 constituting the horizontal drive 7, i.e., the cylinder unit 92 is alone activated to extend the cylinder rod 92*a* for advancing the steam supply head 5. Since the cylinder unit 92 is alone activated, the steam head 5 is held at an intermediate position of FIG. 12B between the positions of FIGS. 12A and 12C. At this intermediate position, the steam supply head 5 is not immediately above the die 2 or not immediately below the sand supply head, but is rather close to the die 2 and is held standby.

After the sand supply head 4 completes its movement to the position immediately above the clamped die 2, the cylinder unit 52 constituting the vertical drive 6 is activated to extend its cylinder rod 52*b* downward for lowering the sand supply head 4. When the sand supply head 4 is lowered, the sand nozzle 8 at the lower end of the sand supply head 4 is aligned and sealed to the injection inlet 1 at the upper end of the die 2, as shown in FIG. 10. At the same time, the pusher cylinder unit 67 is activated to extend its cylinder rod 67*a* downward, thereby pressing the pusher barrel 62 at the lower end of the cylinder rod against the upper end of the sand introduction barrel 57 of the sand supply head 4. With this pressing of the pusher barrel 72 against the sand introduction barrel 57, the pusher barrel 72 has its opening 72*a* communicated with the opening 57*a* of the sand introduction barrel 57 with the sealing ring 74 being compressed to give hermetical seal therebetween. In this condition, the compressed air is fed through the air tubing 13 into the pusher barrel 72, rushing into the sand introduction barrel 57, as indicated by an arrow in FIG. 10, to pressurize the sand supply head 4, thereby dispensing the thickener-coated sand 3 from within the sand supply head 4 out through the sand nozzle 8, as indicated by arrows in FIG. 8B, and charging it in the cavity 33 of the die 2 through the injection inlet 1.

Thus, the compressed air forces to blow the thickener-coated sand 3 into the die 2 from the sand supply head 4 to supply the sand in a short time and thoroughly into the die without causing compacting failure. The compressed air rushing into the die 2 is released from the air vent 34.

When the die 2 is filled with the thickener-coated sand 3 supplied from the sand supply head 4, the compressed air stops being supplied through the air tubing 13. Also the cylinder unit 52 of the vertical drive 6 is activated to withdraw the cylinder rod 52*b*, while the pusher cylinder unit 67 is activated to withdraw the cylinder rod 67*a*, thereby lifting the sand supply head 4 while keeping it immediately above the die 2.

Then, the cylinder unit 93 constituting the horizontal drive 7 with the cylinder unit 92 is alone activated to extend the cylinder rod 93*a*, thereby advancing further the steam supply head 5 from the standby position of FIG. 12B to a point where the steam supply head 5 is interposed between the die 2 and the sand supply head 4 while being positioned immediately below the sand supply head 4, as shown in FIG. 12C. The steam supply head 5 is held on the lower side of the retainer frame plate 87 attached to the slide frame 83. When advanced as shown in FIG. 12C, the steam supply head 5 comes to a position immediately below the sand supply head 4 with the opening 87*a* of the retainer frame plate 87 interposed therebetween, as shown in FIG. 13A.

Figure 13B:
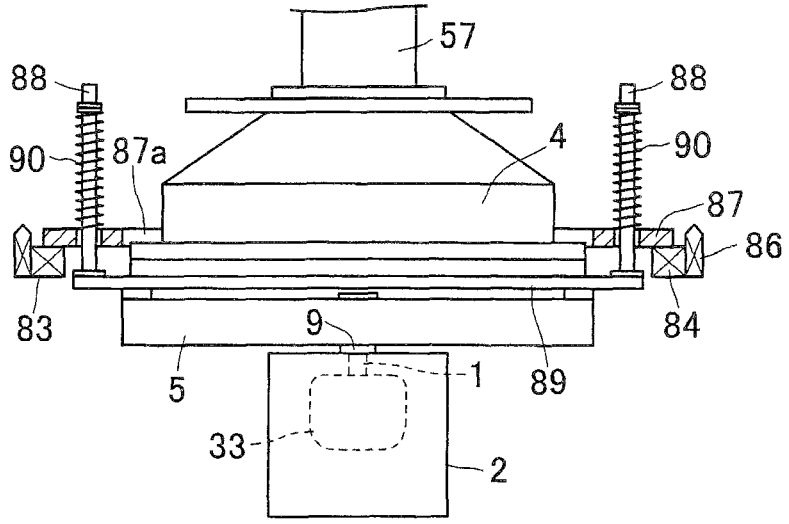
FIG. 13B is a sectional view of the steam supply head lowered for connection with the die.

Then, the cylinder unit 52 of the vertical drive 6 is activated to extend its cylinder rod 52*b* downward for lowering the sand supply head 4. At the same time, the pusher cylinder unit 67 may be activated to extend its cylinder rod 67*a* downward for pressing the pusher barrel 72 against the sand supply head 4. As shown in FIG. 13B, the sand supply head 4 is lowered through the opening 87*a* of the retainer frame plate 87 and comes into abutment with the upper face of the elevator plate 89 to press it downward. As the elevator plate 89 is vertically movable and biased upward by the spring 90, the elevator plate 89 is lowered while squeezing the spring 90 when it is pressed by the sand supply head 4, thereby lowering the steam supply head 5 held on the lower side of the elevator plate 89. As the steam supply head 5 is lowered to bring the nozzle 9 into mating and sealing relation with the injection inlet 1 of the die 2, as shown in FIG. 13B, whereby the steam being fed to the steam supply head 5 through the steam feed hose 91 is allowed to blow into the cavity 33 of the die 2 through the injection inlet 1 from the steam nozzle 9, as indicated by arrows in FIG. 11. The steam blown into the cavity 33 is released from the air vent 34 after permeating through the thickener-coated sand 3.

In order to press the steam nozzle 9 of the steam supply head 5 intimately with the injection inlet 1 of the die 2 for avoid the steam leaking, the vertical drive 6 operates to lower the sand supply head 4 which in turn press the steam supply head 5 downward. Thus, the vertical drive 6 for the sand supply head 4 is best utilized to press the steam supply head 5 for bringing the steam nozzle 9 into intimate contact with the injection inlet 1, which eliminates necessity of providing an additional cylinder unit for pressing down the steam supply head 5.

The steam is constantly fed into the steam supply head 5 through the steam fed hose 91, and is therefore discharged out through the steam nozzle 9 even when the die 2 is not supplied with the steam. In this consequence, the steam supply head 5 is kept away from the die 2 when the die 2 is opened, as shown in FIG. 12A, to keep the die 2 out of the influence of the steam. However, if the steam supply head 5 is driven to advance from a position remote from the die 2 to a position immediately above the die 2 for the purpose of blowing the steam into the die 2 already filled with the thickener-coated sand 3, the steam supply head 5 is necessitated to travel a long distance in a corresponding long time, thus elongating the mold forming cycle. In order to avoid the elongated mold forming cycle, the steam supply head 5 is driven to advance to the standby position near the die 2, as shown in FIG. 12B, until the die 2 is clamped and supplied with the thickener-coated sand 3 from the sand supply head 5. Then, immediately after completing the supply of the thickener-coated sand 3 into the die 2, the steam supply head 5 is driven to advance from the standby position near the die 2 to the position immediately above the die 2 only within a short time, as shown in FIG. 12C, thereby shortening the mold forming cycle.

As described in the above, when the steam is supplied into the die 2 filled with the thickener-coated sand 3, the steam comes into contact with particles of the thickener-coated sand 3 and condenses as a consequence of being deprived of its latent heat by the sand. However, since the steam has inherently high latent heat, the latent heat transferred to the thickener-coated sand 3 upon condensation of the steam will heat the thickener-coated sand 5 quickly up to around 100° C. The steam will transfer its latent heat to the thickener-coated sand 3 so as to heat it up to around 100° C. normally within a relatively short time period of 3 to 30 seconds, although the time period depends on the volume of the thickener-coated sand 3 filled in the die 2, the temperature of the steam, and flowing amount of the steam into the die 2. The steam blown into the die 2 is released from the air vent 34 after heating the thickener-coated sand 3 in the die 2.

Thus, the steam blown into the die 2 will give condensation latent heat to quickly heat the thickener-coated sand 3, while the resulting condensed water in the die 2 will be heated by successively supplied steam to evaporate for heating the die 2 quickly to the temperature of the steam, enabling to heat the thickener-coated sand 3 at the temperature.

When a thermosetting resin is utilized as the thickener of the thickener-coated sand 3, the condensation latent heat of the steam will heat the thickener-coated sand 3 filled in the die 2 up to a temperature above a curing temperature of the thermosetting resin for melting and curing the thickener, whereby the particles of the refractory material (sand) are bonded together by the thickener to form the mold.

When the thickener of the thickener-coated sand 3 is selected from the sugar, water soluble inorganic compound, water soluble thermoplastic resin, the steam initially blown into the die 2 comes into contact with the thickener-coated sand 3 and is condensed as being deprived of its heat. The resulting condensed water reacts with the thickener in a solid phase of the thickener-coated sand 3. The thickener, when made of the sugar, becomes swelled by absorption of the condensed water or dissolved in the water, and therefore gelatinized. The thickener, when made of the water soluble inorganic compound or water soluble thermoplastic resin, becomes dissolved in the condensed water and gelatinized. The thickeners of these kinds become equally gelatinized to exhibit viscosity. Thus acquired viscosity are utilized for adhere the particles of the refractory material of the thickener-coated sand 3 filled in the die 2. The steam subsequently blown into the die 2 gives its condensation latent heat to heat the thickener-coated sand 3, thereby evaporating the water content existing in the gelatinized thickener for drying and solidifying the thickener. Through the solidification, the thickener bonds together the particles of the refractory material, thereby forming the mold.

As described in the above, the thickener-coated sand 3 is heated by the steam supplied into the die 2. The steam has inherently high condensation latent heat by which the thickener-coated sand 3 is heated quickly to cure or solidify the thickener. Accordingly, there is no need to preliminary heat the die 2 to a high temperature, and the mold can be fabricated successfully in a short time of period, thus improving productivity of fabricating the mold. Further, even if a toxic gas should develop out of the thickener, the condensed water from the steam can absorb such toxic gas to reduce possible environmental contamination.

It is noted here that superheated steam is preferably utilized as the steam, although saturated vapor can be equally utilized. The superheated steams is vapor of completely gas phase obtained by heating the saturated vapor to a temperature above its boiling point, and is a dry steam having a temperature of above 100° C. The superheated steam may be the saturated vapor that is heated to expand at a constant pressure, or may be pressurized steam that is heated at an increased pressure without expansion. The superheated steam can be heated up to a temperature of 900° C., and is blown into the die 2 at a suitable temperature between 100° C. and 900° C.

As shown in the embodiment of FIG. 11, a superheater 14 is employed to heat the saturated vapor developed in a boiler 115 to prepare the superheated steam which is fed through the steam feed hose 91 to the steam supply head 5.

After the steam is blown into the die 2 to fabricate the mold, the cylinder unit 52 of the vertical drive 6 is activated to withdraw the cylinder rod 52*b*, thereby moving the sand supply head 4 upward. Upon moving upward, the sand supply head 4 releases its pressure to the elevator plate 89 which responds to move upward under the bias of the spring 90. At this time, the steam supply head 5 carried on the lower side of the elevator plate 89 is caused to move away from the die 2, see FIG. 12C and FIG. 13A.

Subsequent to the upward movement of the sand supply head 4, the cylinder units 46 and 47 of the sand supply horizontal drive 11 are activated to withdraw the individual cylinder rods 46*a* and 47*a*, thereby moving the sand supply head 4 rearward from the position immediately above the die 2 and on the left side of the guide 38, as indicated by solid lines in FIG. 3, to the position immediately below the sand tank 10, as indicated by dotted lines in FIG. 3.

The die 2 has its upper face cleaned while the sand supply head 4 moves away from the position immediately above the die 2. For this purpose, the sand supply head 4 is provided on opposite side of the sand supply horizontal drive 11 with a scraper support 111 carrying a scraper 110. The scraper 110 has its one end pivotally connected to the scraper support 111 to pivot about a horizontal axis. The scraper support 111 also carries a cylinder unit 112 with a cylinder rod 112*a* which is pivotally connected at its lower end to the scraper 110. The cylinder rod 112*a* of the cylinder unit 112 is normally kept withdrawn upwardly so that the scraper 110 is pulled up after being pivoted about the horizontal axis, as indicated by solid lines in FIG. 3. When the sand supply head 4 moves away from the position immediately above the die 2, the cylinder unit 112 is activated to extend its cylinder rod 112*a* downward, thereby rotating the scraper 110 downward and keeping it in position, as indicated by dotted lines in FIG. 3. Thus, the scraper 110 moves together with the sand supply head 4 to scrape off the thickener-coated sand 3 adhered on the upper face of the die 2, thus accomplishing the die cleaning. Before the sand supply head 4 comes to the position above the die 2 through its movement from the position immediately below the sand tank 10, the scraper 110 is driven to pivot upward about the horizontal axis to be pulled up.

When the sand supply head 4 moves to the position immediately below the sand tank 10, as indicated by dotted lines of FIG. 3, the sand shutter 71 opens to feed the thickener-coated sand 3 from the sand tank 10 to the sand supply head 4 to make it ready for the next mold fabrication, see FIG. 9A. As the sand supply head 4 is first to receive the thickener-coated sand 3 from the sand tank 10 and is subsequently driven to move towards the die 2 for injecting the thickener-coated sand 3 into the die 2, the sand supply head 4 can be made compact sufficient to store one shot of the thickener-coated sand 3 to be injected into the die 2.

As the sand supply head 4 moves backward, the steam supply head 5 is synchronized to move backward. That is, the cylinder units 92 and 93 of the horizontal drive 7 are activated to withdraw the individual cylinder rods 92*a* and 93*a* to move the steam supply head 5 to a rearward-most position, as shown in FIG. 12A, to make it ready for next the mold fabrication.

Subsequently, the die 2 is opened. That is, the die clamping cylinder unit 30 are activated to withdraw its cylinder rod 30*a* for moving the movable die half 2*b* away from the fixed die half 2*a*, thereby opening the die 2 for removal of the mold out of the cavity 33 of the die 2.

An air duster 107 is provided to clean inside of the die halves 2*a* and 2*b* which are kept separated from one another after the opening of the die 2. As shown in FIG. 1, the air duster 107 includes a pair of air nozzles 107*a*, and is connected to one side of the support beam 37 by means of a cylinder unit 108 to be disposed above the die 2. The cylinder unit 108 includes a cylinder rod 108*a* which is connected at its end with the air duster 107. When the die 2 is opened to remove the mold out of the die 2, the cylinder unit 108 is activated to extend its cylinder rod 108*a* downward, thereby moving the air duster 107 downward and into between the opened die halves 2*a* and 2*b*. Then, the air duster 107 spouts the compressed air through the air nozzles 107*a* and 107*b* against the inside surfaces of the die halves 2*a* and 2*b* to clean off the surfaces. After spouting the compressed air from the air nozzles 107*a* and 107*b*, the air duster 107 moves back to its original position by withdrawal of the cylinder rod 108*a*.

FIG. 14 illustrates another embodiment of the present invention made in consideration of that the above embodiment utilizes the die 2 having only one injection inlet 1 in its upper surface. When fabricating a relatively large mold, especially having a large planar surface with the use of only one injection inlet 1, it may be rather difficult to reach the steam thoroughly and uniformly in to the die 2, possibly failing to uniformly heat the thickener-coated sand 3 filled in the die 2.

Figure 14A:
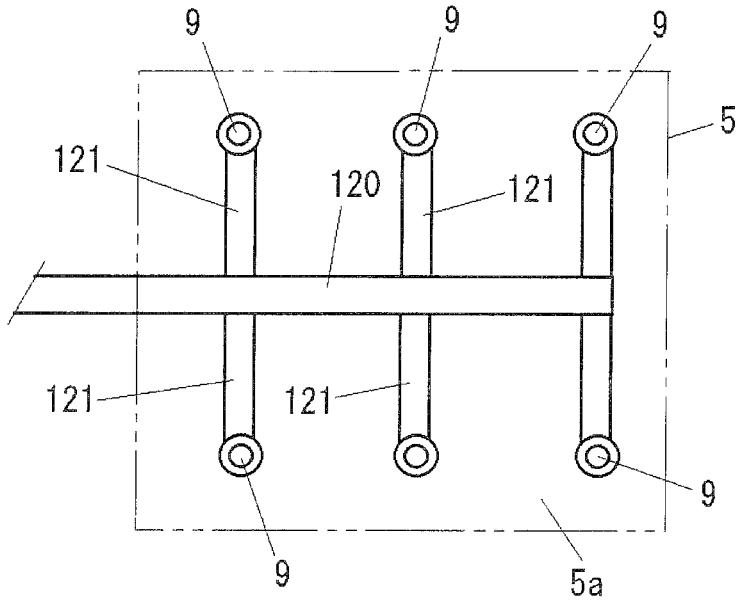
FIG. 14A is a schematic bottom view of a steam supply head in accordance with another embodiment of the present invention.
Figure 14B:
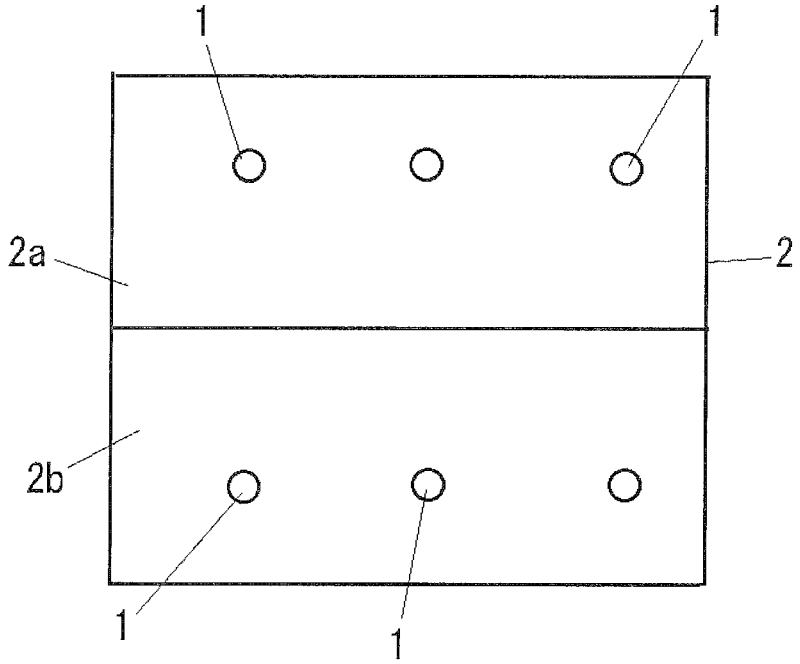
FIG. 14B is a schematic plan view of a die in accordance with a further embodiment of the present invention.

In view of this, the present embodiment is configured to employ the die 2 having multiple injection inlets 1 distributed in the upper surface of the die 2, as shown in FIG. 14B. To this end, the steam supply head 5 is configured to have multiple nozzles 9 respectively in match with the injection inlets 1, as shown in FIG. 14A, to supply the steam therethrough into the die 2

The steam supply head 5 is configured to have a main body 5*a* with steam pipe 120 connected to the steam feed hose 91. The steam pipe 120 includes multiple branch pipes 121 provided at the respective ends with the nozzles 9 each positioned in match with each of the injection inlets 1. Thus configured steam supply head 5 is attached to the underside of the elevator plate 89 and used in the same manner as described with reference to FIG. 13

When supplying the steam into the die 2, the steam supply head 5 is lowered in the same manner as described with reference to FIG. 13B, the steam supply head 5 has its nozzles 9 mated respectively with the injection inlets 1 in the upper surface of the die 2. Thus, the steam is supplied from the nozzles 9 into the die 2 through all of the injection inlets 1, enabling to reach the steam uniformly and thoroughly inside of the die 2, thereby heating uniformly the thickener-coated sand 3 filled in the die 2 and therefore enabling to fabricate the mold of homogeneous structure.

LIST OF REFERENCE NUMERALS

1 injection inlet
2 mold forming die
3 thickener-coated sand
4 sand supply head
5 steam supply head
6 vertical drive
7 horizontal drive
8 sand nozzle
9 steam nozzle
10 sand tank
11 sand supply horizontal drive
12 sand supply head pusher unit
13 air tubing
14 superheater

The invention claimed is:

1. A cast mold fabrication device comprising:

a mold forming die having an injection inlet;

a sand supply head provided with a sand nozzle and configured to supply thickener-coated sand through said injection inlet into said die, said thickener-coated sand being a refractory material coated with a thickener;

a steam supply head provided with a steam nozzle and configured to supply steam through said injection inlet into said die filled with the thickener-coated sand for applying heat of the steam to solidify and/or cure the thickener of said thickener-coated sand;

a vertical drive arranged to move said sand supply head up and down; and a horizontal drive arranged to move said steam supply head back and forth in the horizontal direction, said vertical drive being configured to move the sand supply head down to a position where the sand nozzle is connected to the injection inlet for allowing the thickener-coated sand to be injected into the die, said horizontal drive being configured to move the steam supply head forward to a position where the steam nozzle is connected to the injection inlet for allowing the steam to be supplied into the die, said steam supply head being floatingly supported to a base to be vertically movable and biased upwardly, and said vertical drive being configured to lower the sand supply head to press the steam supply head down for bringing the steam nozzle into an intimate connection with the injection inlet, in response to the horizontal drive moving the steam supply head forward to a position above the die.

2. The cast mold fabrication device as set forth in claim 1, wherein said horizontal drive is configured to hold the steam supply head in a forward position where the steam nozzle is connected to the injection inlet, a rearward position where the steam supply head is away from the die, and a standby position intermediate between the forward position and the rearward position, said horizontal drive is configured to hold the steam supply head in the standby position while the sand supply head is activated to supply the thickener-coated sand into the die, and move the steam supply head to the forward position in response to that the sand supply head is lifted by the vertical drive after finishing the supply of the thickener coated sand into the die.

3. The cast mold fabrication device as set forth in claim 2, further comprising:

a sand tank for storing the thickener-coated sand;

a sand supply horizontal drive configured to move the sand supply head back and forth in the horizontal direction, said sand supply horizontal drive being configured to move the sand supply head back to a position below the sand tank for feeding the thickener-coated sand into the sand supply head, and configured to move the sand supply head forward to a position above the die for supplying the thickener-coated sand into the die.

4. The cast mold fabrication device as set forth in claim 1, further comprising:

a sand tank for storing the thickener-coated sand;

a sand supply horizontal drive configured to move the sand supply head back and forth in the horizontal direction, said sand supply horizontal drive being configured to move the sand supply head back to a position below the sand tank for feeding the thickener-coated sand into the sand supply head, and configured to move the sand supply head forward to a position above the die for supplying the thickener-coated sand into the die.

* * * * *